US010895122B2

(12) United States Patent
Saraya

(10) Patent No.: US 10,895,122 B2
(45) Date of Patent: Jan. 19, 2021

(54) METHODS AND SYSTEMS FOR DISCONNECTING CASING

(71) Applicant: Vertice Oil Tools, Missouri City, TX (US)

(72) Inventor: Mohamed Ibrahim Saraya, Sugarland, TX (US)

(73) Assignee: Vertice Oil Tools Inc., Missouri City, TX (US)

( * ) Notice: Subject to any disclaimer, the term of this patent is extended or adjusted under 35 U.S.C. 154(b) by 3 days.

(21) Appl. No.: 16/256,804

(22) Filed: Jan. 24, 2019

(65) Prior Publication Data

US 2020/0240223 A1 Jul. 30, 2020

(51) Int. Cl.

| | |
|---|---|
| ***E21B 17/02*** | (2006.01) |
| ***E21B 17/046*** | (2006.01) |
| ***E21B 17/06*** | (2006.01) |
| ***E21B 23/00*** | (2006.01) |
| ***E21B 31/20*** | (2006.01) |
| ***E21B 33/13*** | (2006.01) |
| ***E21B 34/06*** | (2006.01) |

(52) U.S. Cl.

CPC ..... *E21B 23/00* (2013.01); *E21B 17/02* (2013.01); *E21B 17/046* (2013.01); *E21B 17/06* (2013.01); *E21B 31/20* (2013.01); *E21B 33/13* (2013.01); *E21B 34/063* (2013.01)

(58) Field of Classification Search

CPC ..... E21B 17/02; E21B 17/046; E21B 17/06

See application file for complete search history.

(56) References Cited

U.S. PATENT DOCUMENTS 3,166,128 A * 1/1965 Myers ..... E21B 34/14 166/214
3,278,220 A * 10/1966 Wilson ..... E21B 19/06 294/86.25
3,677,346 A * 7/1972 Tamplen ..... E21B 23/006 166/385
4,452,472 A * 6/1984 Crase ..... E21B 4/02 285/18
5,984,029 A * 11/1999 Griffin ..... E21B 17/06 175/321

* cited by examiner

*Primary Examiner* — Cathleen R Hutchins
(74) *Attorney, Agent, or Firm* — Pierson IP, PLLC

(57) ABSTRACT

Examples describe systems and methods for a tool to remove portions of casing from a wellbore. A tool may include a bottom sub-assembly and casing that selectively detach from a sub-assembly. This may allow for tools and casing within the wellbore to be efficiently and effectively removed from the wellbore without having to cut tools down well.

20 Claims, 7 Drawing Sheets

METHODS AND SYSTEMS FOR DISCONNECTING CASING

BACKGROUND INFORMATION

Field of the Disclosure

Examples of the present disclosure relate to disconnect portions of casing from a wellbore. More specifically, embodiments include a tool with an upper sub-assembly and lower sub-assembly that are configured to be detached from each other while inside the wellbore.

Background

Directional drilling is the practice of drilling non-vertical wells. Horizontal wells tend to be more productive than vertical wells because they allow a single well to reach multiple points of the producing formation across a horizontal axis without the need for additional vertical wells. This makes each individual well more productive by being able to reach reservoirs across the horizontal axis. While horizontal wells are more productive than conventional wells, horizontal wells are costlier.

Conventionally, casings can be run all way to the surface which adds an extra cost of casing length. Other methods can include hanging the casing just above the horizontal or deviated section using a packer, a liner hanger, combination of both. Although this can be a cheaper method, it is still expensive and increases operational complexity. Alternative methods include running the casing all the way to the surface, then intervening with mechanical or chemical cuts to severe the casing at a point above the horizontal section. However, this provides uncertainty of a shape and condition of the severed portion for re-entry purposes. s.

Accordingly, needs exist for systems and methods to mechanically remove or disconnect portions of casing and assemblies from a wellbore, while the assemblies are within the wellbore.

SUMMARY

Embodiments disclosed herein describe systems and methods for a tool to remove portions of casing and assemblies from a wellbore. In embodiments, a bottom sub-assembly and casing may be configured to be selectively detached from an upper sub-assembly. This may allow for tools and casing within the wellbore to be efficiently and effectively removed from the wellbore without having to cut tools downhole. Embodiments may include a bottom sub-assembly, housing, and upper sub-assembly. In other concepts, the embodiments disclosed herein may describe systems and methods for a tool to be used to severe, detach portion of the casing or assembly from the rest of the casing joints without removing the detached casing from the well bore Embodiments may further include an upper sub-assembly connected to a collet, dogs, dies, or any other device (hereinafter collectively and individually referred to as "collet"). The collet may shoulder on a no go, the embodiments may further form two independent parts, the upper sub-assembly and the lower sub-assembly. The upper sub-assembly and the lower sub-assembly may be run in the wellbore as a single piece. The collet may be further supported with a support sleeve, which is connected to the upper sub-assembly. The support sleeve may be configured to f support the collet and prevent the collet from collapsing.

The support sleeve may be connected to the upper sub-assembly via shear pins, dissolvable ring, or any other temporary coupling device.

The bottom sub-assembly may include a burst disc. In operation, the tool may be positioned within the wellbore. Pressure within the tool may be increased, and the burst disc may rupture. This may enable circulation at the top of the casing to circulate any excess cement that was bumped through the tool and through the casing shoe and back into the annulus side within the wellbore below the tool to return through the tool. The bottom sub-assembly may also include a cutout that allows for the linear movement of a support sleeve.

The housing may have a distal end coupled the bottom sub-assembly. A proximal end of the housing may be positioned adjacent to the top sub-assembly. The housing may be positioned adjacent to a wellbore, or on an inner diameter of existing casing. This may enable the tool to be positioned within existing casing, or next to the geological formation. In embodiments, the housing may include a no-go that is configured to decrease the inner diameter from a first inner diameter to a second inner diameter. The no-go may be configured to limit the movement of the upper sub-assembly towards the distal end of the housing in a first mode of operation, while allowing the movement of the upper sub-assembly towards the distal end of the housing in a second mode of operation. In other concepts, the outer housing may be a part of the upper sub or the bottom sub.

The top sub-assembly may include an outer sidewall, adjuster sleeve, and support sleeve. The outer sidewall may be configured to be positioned adjacent to the distal end of the housing in the first mode of operation, and be coupled to the adjuster sleeve. In other concepts, the support sleeve may be a part of the bottom sub-assembly.

The adjuster sleeve may include an upper portion, shaft, and lower portion. The upper portion may include a groove, positioned on an inner sidewall of the adjuster sleeve, which is configured to receive the support sleeve in the first mode of operation. An outer sidewall of the adjuster sleeve may be configured to be positioned adjacent to the housing. The shaft of the adjuster sleeve may be configured to increase an inner diameter across adjuster sleeve between the upper portion and lower portion of the adjuster sleeve. The lower portion of the adjuster sleeve may include an inner projection and an outer projection. The inner projection may be configured to decrease the inner diameter of the lower portion of the adjuster sleeve, and the outer projection may be configured to increase the outer diameter of the lower portion of the adjuster sleeve.

The support sleeve may include a seat, first outcrop, and second outcrop. The seat may be configured to decrease the inner diameter across the support sleeve, and allow a ball to rest within the support sleeve. Responsive to the ball being positioned on the seat, pressure within the tool above the ball may increase, allowing the support sleeve to detach from the adjuster sleeve at a first location and move towards the distal end of the wellbore. This may allow the support sleeve to move towards a distal end of the wellbore. In other concepts, the support sleeve may be connected to the bottom sub-assembly.

The support sleeve may further include, a length extension, a weak point or a recess that allows receiving a mechanical or chemical cut to severe it. Hence provide a secondary mechanism to disconnect the housing if the ball drop mechanism fails or if the user opt not to use the ball.

The first outcrop and the second outcrop may be positioned on an outer sidewall of the support sleeve, and increase an outer diameter the support sleeve. A slot may be formed between the first outcrop and the second outcrop. Responsive to the support sleeve moving towards a distal end of the wellbore, the inner projection of the adjuster sleeve may be positioned within the slot, and against a lower surface of the second outcrop. When the adjuster sleeve applies forces towards a proximal end of the wellbore, the inner projection of the adjuster sleeve may apply forces against the second outcrop, coupling the support sleeve and adjuster sleeve at a second location, and pull the support sleeve towards the proximal end of the wellbore.

These, and other, aspects of the invention will be better appreciated and understood when considered in conjunction with the following description and the accompanying drawings. The following description, while indicating various embodiments of the invention and numerous specific details thereof, is given by way of illustration and not of limitation. Many substitutions, modifications, additions or rearrangements may be made within the scope of the invention, and the invention includes all such substitutions, modifications, additions or rearrangements.

BRIEF DESCRIPTION OF THE DRAWINGS

Non-limiting and non-exhaustive embodiments of the present invention are described with reference to the following figures, wherein like reference numerals refer to like parts throughout the various views unless otherwise specified.

Figure 1:
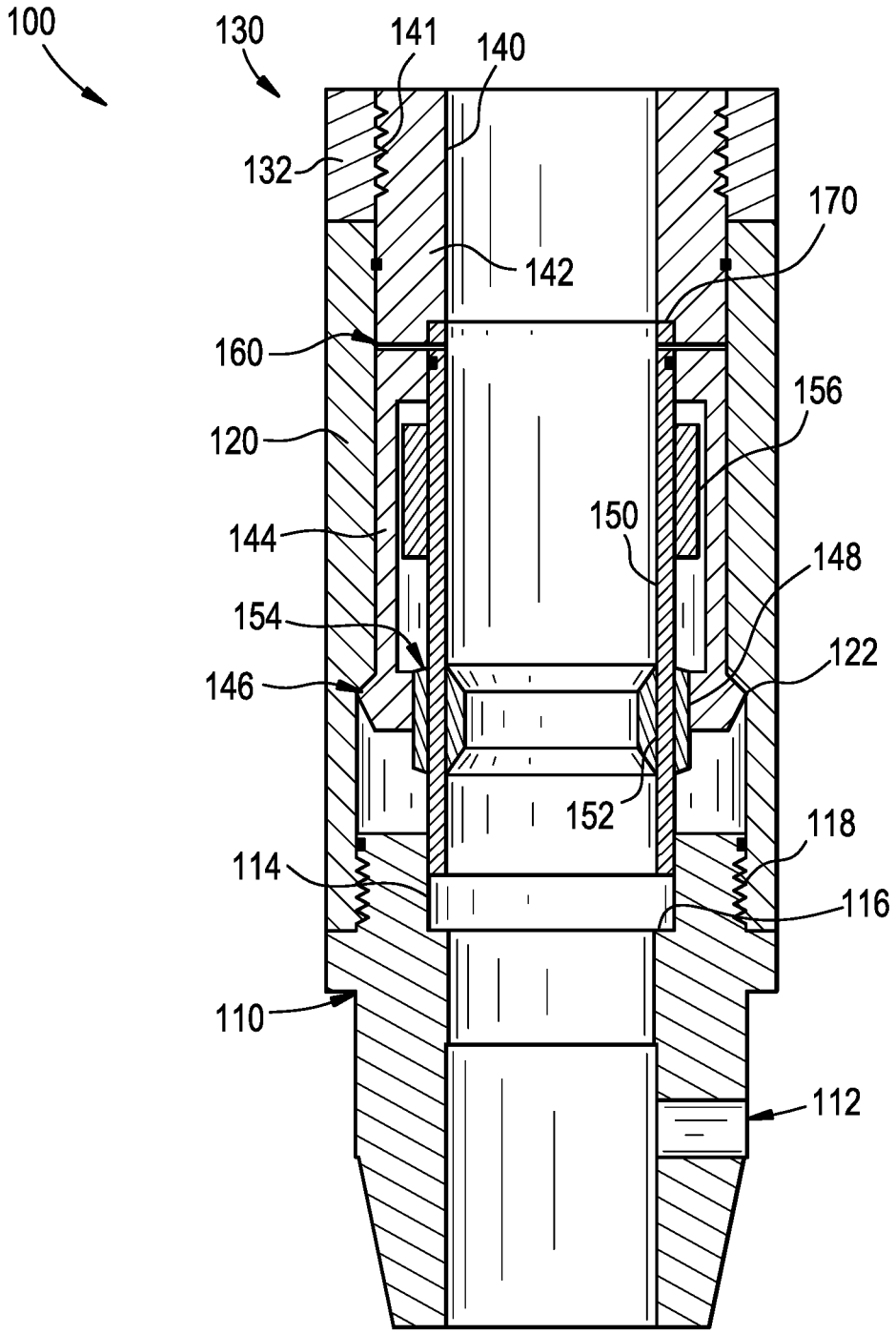
FIG. 1 depicts a downhole tool, according to an embodiment.

Corresponding reference characters indicate corresponding components throughout the several views of the drawings. Skilled artisans will appreciate that elements in the figures are illustrated for simplicity and clarity and have not necessarily been drawn to scale. For example, the dimensions of some of the elements in the figures may be exaggerated relative to other elements to help improve understanding of various embodiments of the present disclosure. Also, common but well-understood elements that are useful or necessary in a commercially feasible embodiment are often not depicted in order to facilitate a less obstructed view of these various embodiments of the present disclosure.

DETAILED DESCRIPTION

In the following description, numerous specific details are set forth in order to provide a thorough understanding of the present invention. It will be apparent, however, to one having ordinary skill in the art that the specific detail need not be employed to practice the present invention. In other instances, well-known materials or methods have not been described in detail in order to avoid obscuring the present invention.

FIG. 1 depicts a detachable tool 100 for use in a wellbore, according to an embodiment. In embodiments, the detachable tool 100 may be configured to be run in hole (RIH) with a balanced pressure where the connection is not shearable. In embodiments, a shearing element, such as a shear pin may be connected to a support sleeve, which supports the collet, and may be balanced as long as a ball is not seated on a ball seat. This may enable shearable, burstable, etc. elements of tool 100 to remain intact while being RIH. Tool 100 may include a bottom sub-assembly 110, housing 120, and top-sub assembly 130.

Bottom sub-assembly 110 may be configured to be positioned at a distal end of a wellbore. Bottom sub-assembly 110 may include a burst disc 112, slot 114, and coupling mechanism 118.

Burst disc 112 may be configured to be positioned in a passageway that extends from an inner diameter of tool 100 to an annulus positioned between tool 100 and another structure, such as an outside casing or a geological formation. Burst disc 112 may be configured to rupture, break, fragment, dissolve, etc. by applying a predetermined pressure across the rupture disc or after a predetermined amount of time. In embodiments, before burst disc 112 is ruptured the annulus between an outer diameter of tool 100 and the inner diameter of tool 100 may be isolated from each other. Responsive to burst disc 112 being ruptured, there may be communication between the annulus and the inner diameter of tool 100 via the exposed passageway. This may enable excess cement and fluid to travel through the passageway and towards the surface. In other embodiments, the burst disc may be placed in the housing or the top sub-assembly or directly adjacent to the collet Slot 114 may be a groove, indention, etc. positioned on an inner diameter of the proximal end of bottom sub-assembly 110. Slot 114 may increase an inner diameter across bottom sub-assembly 110 to allow portions of top-sub assembly 130 to move towards the distal end of tool 100. However, a ledge 116 may be positioned on an end of slot 114 that decreases the inner diameter across bottom sub-assembly 110, which is configured to limit the movement of the portions of top-sub assembly 130 towards the distal end of tool 100.

Coupling mechanisms 118 may be positioned on an outer diameter of the proximal end of bottom sub-assembly 110. The coupling mechanisms 118 may be configured to selectively couple bottom sub-assembly 110 and housing 120.

Housing 120 may be a sidewall with an outer diameter that is configured to be positioned adjacent to an outer casing, wall, cement, or geological formation. In embodiments, a distal end of housing 120 may be coupled to bottom sub-assembly 110, and a proximal end of housing 120 may be coupled to top sub-assembly 130. An upper portion of housing 120 may have a first inner diameter, and a bottom portion of housing 120 may have a second inner diameter, wherein the second inner diameter is greater than the first inner diameter.

A no-go 122 may be positioned between the upper and lower portions of housing 120, wherein no-go 122 may be configured to limit the movement of upper sub-assembly 130 when shear pin 160 is coupling adjuster sleeve 140 and support sleeve 150. As such, when adjuster sleeve 140 and support sleeve 150 are coupled together via shear pin 160, no-go 122 may form an overhang over portions of adjuster sleeve 140. This may limit the movement of upper sub-assembly towards the proximal end of tool 100 when portions of adjuster sleeve 140 are aligned with no-go 122. However, when portions of adjuster sleeve 140 are not aligned with no-go 122, upper sub-assembly 130 may move towards the proximal end of tool 100. This may enable the removal of upper sub-assembly 130. In an alternative embodiment, the no-go 122 may be part of the lower sub-assembly while the collet 144 may be connected to the upper sub-assembly.

Upper sub-assembly 130 is configured to be inserted and removed from a wellbore independently from lower sub-assembly 110 and/or housing 120. Responsive to increasing the pressure within tool 100, portions of upper sub-assembly may be repositioned and form a mechanical look that is not aligned with housing 120. This may allow upper sub-assembly 130 to move towards the proximal end of the wellbore. Upper sub-assembly 130 may include an outer sidewall 132, adjuster sleeve 140, and a support sleeve 150.

Outer sidewall 132 may be configured to be positioned on and adjacent to a proximal end of housing 120. By positioning outer sidewall 132 on housing 120, movement of upper sub-assembly 130 towards the distal end of tool 100 may be limited. An inner portion of outer sidewall 132 may be configured to be coupled to a proximal end of adjuster sleeve 140. In other configuration outer side wall 132 and upper sub-assembly 130 may a single, unitary piece.

Adjuster sleeve 140 may include a coupling mechanism 141, upper portion 142, shear pin 160, shaft 144, and a distal end that includes an outer projection 146 and an inner projection 148.

The upper portion 142 of adjuster sleeve 140 may be configured to be coupled with outer sidewall 132 via coupling mechanism 141. Upper portion 142 may include a cutout 170 that is configured to receive a proximal end of support sleeve 150, when support sleeve 150 is in a first position. In embodiments, support sleeve 150 may be retained in the first position until the pressure within tool 100 increases past a threshold to cut/severe shear pin 160. This may decouple adjuster sleeve 140 and support sleeve 150 at a location associated with shear pin 160. In other embodiments, the adjuster sleeve 140 and the outer side wall 132 may be one piece.

Shaft 144 may be positioned between upper portion 142 and the distal end of adjuster sleeve 140. Shaft 144 may be configured to be positioned adjacent to an inner sidewall of housing 120 while upper sub-assembly 130 is coupled with lower sub-assembly 110. An inner diameter across shaft 144 may be greater than an inner diameter across the distal end of adjuster sleeve 140 and upper portion 142. In embodiments, shaft 144 may be spring loaded, have a natural flex, etc. that naturally moves the distal end of shaft 144 towards a central axis of tool 100. In other configuration the shaft can be connecting to dogs, dies, etc.

Distal end of adjuster sleeve 140 may be a collet or any other mechanism that is configured to be selectively coupled to housing 120 at a first location or support sleeve 150 at a second location. This may enable upper sub-assembly 130 to be selectively coupled to lower sub-assembly 110, while allowing upper sub-assembly 130 to be mechanically removed from a wellbore. Distal end of adjuster sleeve 140 may include an outer projection 146 and an inner projection 148.

Outer projection 146 may be positioned on an outer sidewall of the distal end of adjuster sleeve 140, and may increase the outer diameter of the distal end of adjuster sleeve 140. Outer projection 146 may be configured to be vertically aligned with no-go 122 in the first mode of operation. This may limit the upward movement of adjuster sleeve 140 while outer projection 146 is aligned with no-go 122. In the second mode, outer projection 146 may not be aligned with no-go 122, such the adjuster sleeve 140 may move unrestricted by no-go 122.

The outer projection 146 may be collets that flex open, dies that retract, dogs supported with spring, or any other device that naturally or through mechanical assistance may have first larger diameter and second smaller diameters Inner projection 148 may be positioned on an inner sidewall of the distal end of adjuster sleeve 140, and may decrease the inner diameter of the distal end of adjuster sleeve 140. Inner projection 146 may be configured to be positioned adjacent to first outcrop 154 of support sleeve 150 in the first mode of operation. In the second mode of operation, inner projection 146 may be configured to be positioned within a groove between first outcrop 154 and second outcrop 156, and may be positioned adjacent to second outcrop 156. This may enable inner projection to apply a force against second outcrop 156 and move support sleeve 150.

Support sleeve 150 may be a device that is configured to be selectively coupled to adjuster sleeve 140 at either a first location or second location, and to move along a linear axis of tool 100. Support sleeve 150 may move towards a distal end of tool 100 responsive to a ball drop and seating on seat 152 and a pressure increase within tool 100, and may move towards a proximal end of tool 100 responsive to adjuster sleeve 140 applying pressure to support sleeve 150 towards the proximal end of tool 100. Support sleeve 150 may include a seat 152, first outcrop 154, and second outcrop 156.

Seat 152 may be a projection extending around the inner circumference of support sleeve 150, which may decrease the inner diameter of support sleeve 150. Seat 152 may be configured to receive a ball, disc, object, seal, etc., and restrict the movement of the ball towards the distal end of tool 100. This may isolate a first area within the tool 100 above seat 152 from a second area within the tool 100 below seat 152. In embodiments, responsive to positioning the ball on seat 152, the pressure within the first area may increase, shearing pin 160, and moving support sleeve 150 towards the distal end of tool 100. In further embodiments, seat 152 may be coupled with an inner support that is configured to mechanically intervene and shear shearing pin 160. This may enable a failsafe to disconnect the upper sub-assembly 130 from lower sub-assembly that is mechanically operated.

First outcrop 154 and second outcrop 156 may be positioned on an outer diameter of support sleeve 150. First outcrop 154 and second outcrop 156 may increase the size of the outer diameter of support sleeve 150 such that a slot may be formed between first outcrop 154 and second outcrop 156. In embodiments, first outcrop 154 may have a smaller outer diameter than that of second outcrop 156.

First outcrop 156 may be configured to be aligned with inner projection 148 in the first mode, which may limit the movement of the distal end of adjuster sleeve 140 towards a central axis of tool 100. In the second mode, the distal end of adjuster sleeve 140 may be aligned the groove/slot between first outcrop 156 and second outcrop 158, and the distal end of adjuster sleeve 140 may be coupled to support sleeve 150 at a second location.

Figure 2:
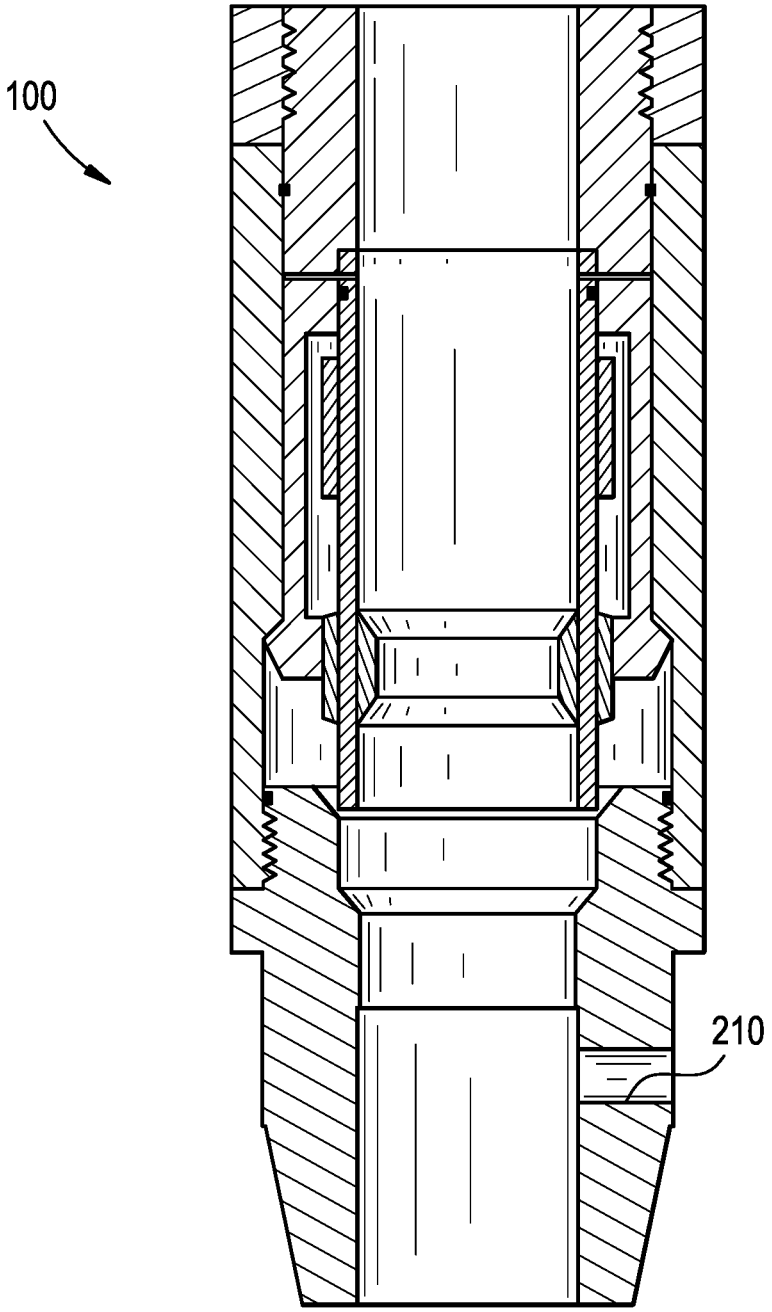
FIG. 2 depicts a downhole tool, according to an embodiment.

FIG. 2 depicts tool 100, according to an embodiment. Elements depicted in FIG. 2 may be described above, and for the sake of brevity a further description of these matters is omitted.

As depicted in FIG. 2, responsive to burst disc 112 being ruptured, passageway 210 extending from an inner diameter of tool 100 to an annulus positioned outside of tool 100 may be exposed. This may allow for communication between the annulus and inner diameter of tool 100.

Figure 3:
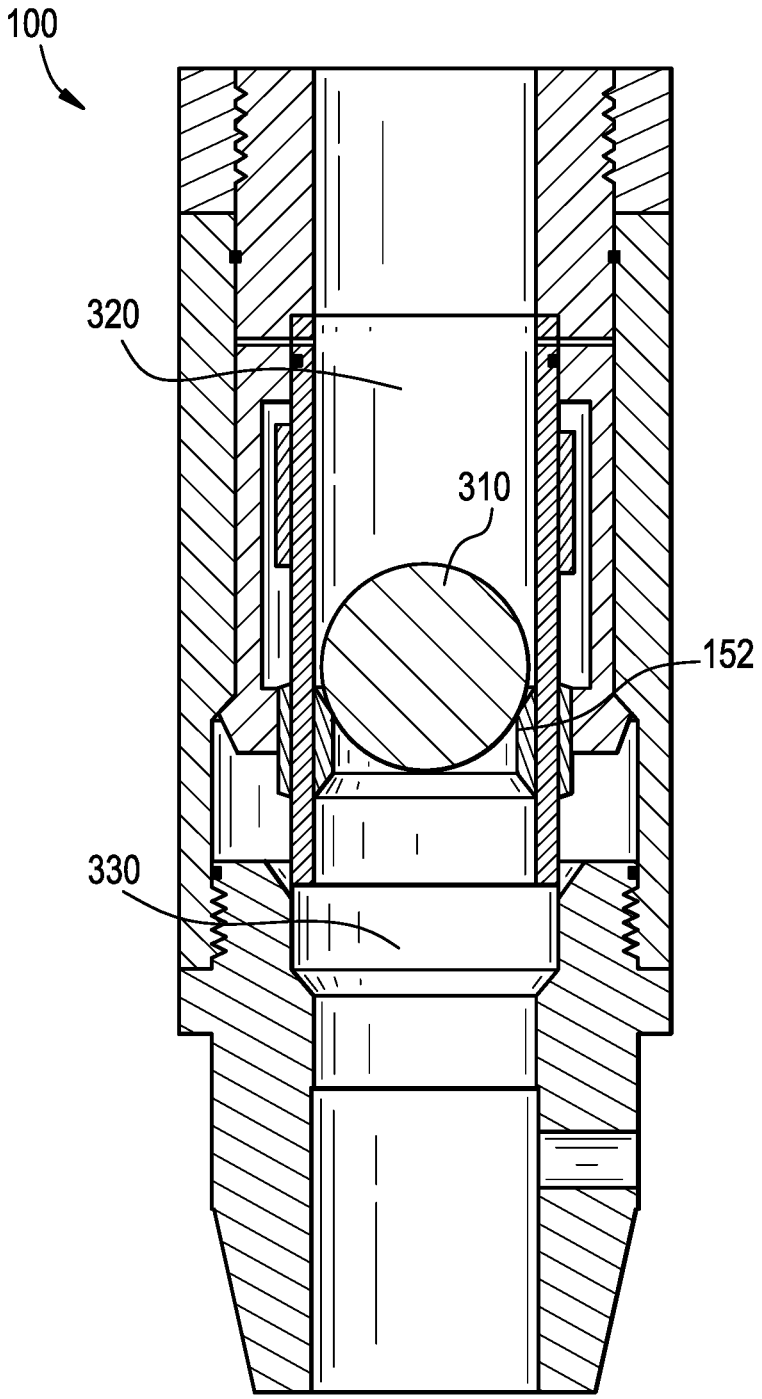
FIG. 3 depicts a downhole tool, according to an embodiment.

FIG. 3 depicts tool 100, according to an embodiment. Elements depicted in FIG. 3 may be described above, and for the sake of brevity a further description of these matters is omitted.

As depicted in FIG. 3, a ball 310 may be configured to sit on seat 152. Responsive to positioning ball 310 on seat 152, a first area 320 above ball 152 within the inner diameter of tool 100 may be isolated from a second area 330 positioned below ball 152.

Figure 4:
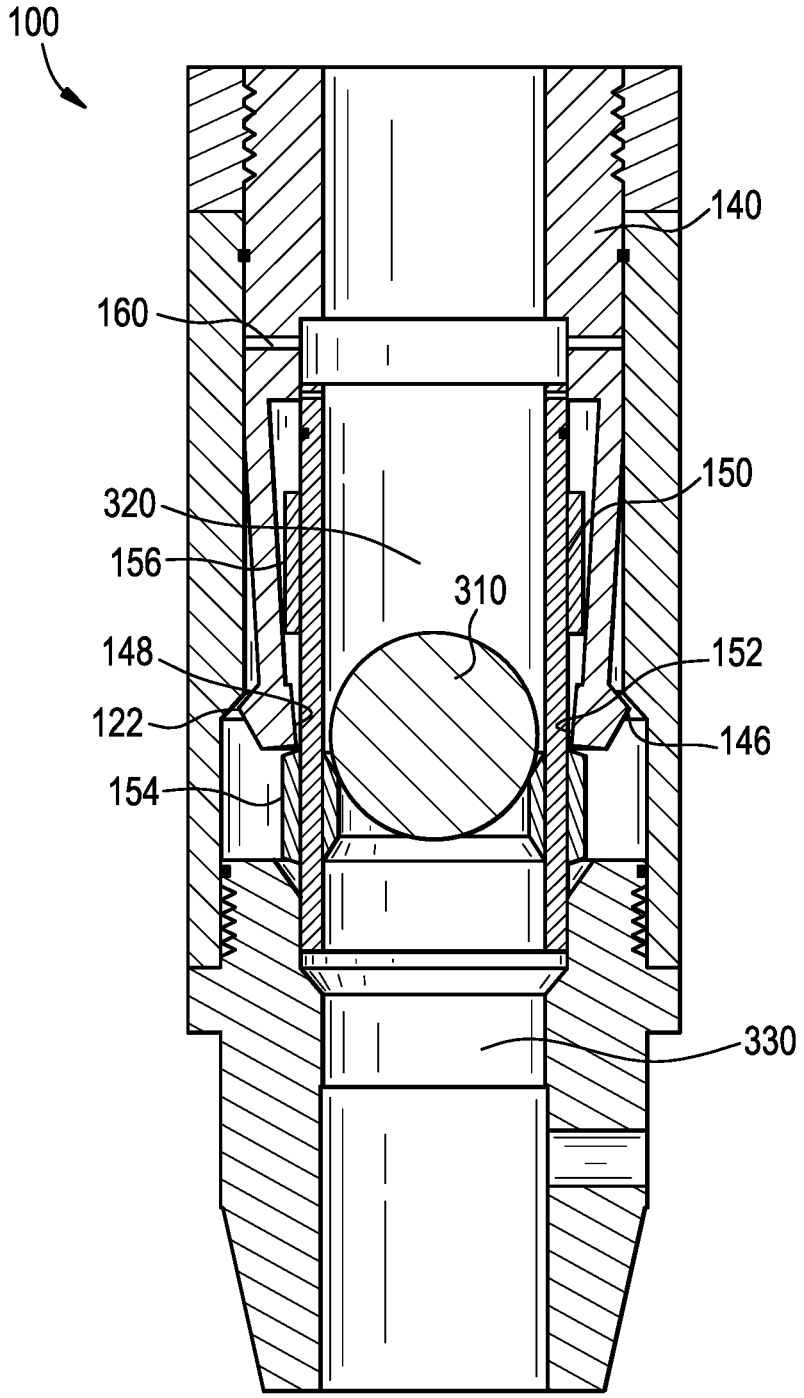
FIG. 4 depicts a downhole tool, according to an embodiment.

FIG. 4 depicts tool 100 in a second mode of operation, according to an embodiment. Elements depicted in FIG. 4 may be described above, and for the sake of brevity a further description of these matters is omitted.

As depicted in FIG. 4, responsive to the pressure within the first area 320 increasing past a threshold, shear pin 160 may shear. This may decouple support sleeve 150 from adjuster sleeve 140 at the first location, allowing support sleeve 150 to move towards the distal end of tool 100. When support sleeve 150 moves towards the distal end of tool 100, inner projection 148 may be positioned adjacent to shaft 152 and between first outcrop 154 and second outcrop 156. This may enable outer projection 146 to be positioned away from no-go 122.

Furthermore, when inner projection 148 is positioned adjacent to shaft 152 and second outcrop 156, support sleeve 150 may be mechanically coupled to adjuster sleeve 140 at a second location.

Figure 5:
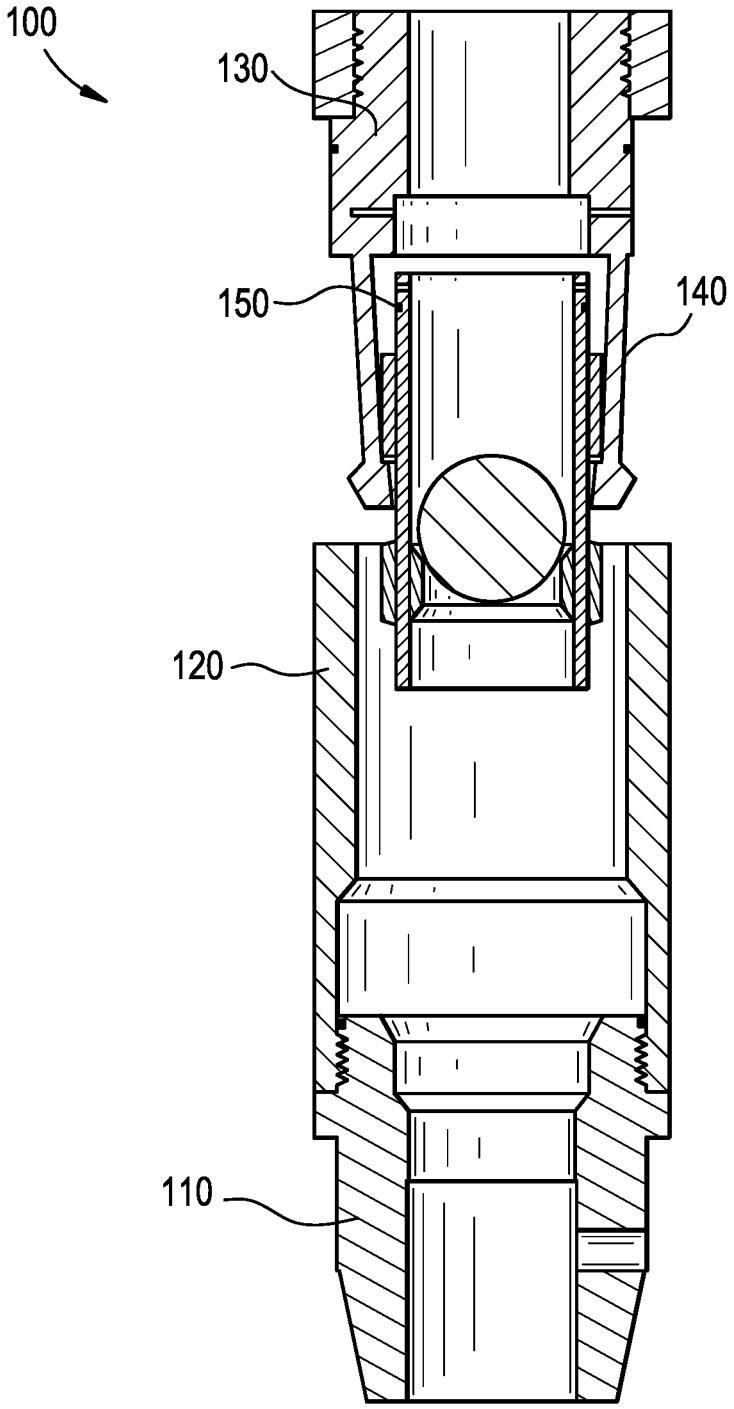
FIG. 5 depicts a downhole tool, according to an embodiment.

FIG. 5 depicts tool 100, according to an embodiment. Elements depicted in FIG. 5 may be described above, and for the sake of brevity a further description of these matters is omitted.

As depicted in FIG. 5 upper sup-assembly 130 may receive an upward force. Due to support sleeve 150 being mechanically coupled to adjuster sleeve 140, upper sub-assembly 130 may move as a single unit, and become detached from housing 120 and lower sub-assembly 110. This may enable portions of tool 100 to be separated and removed from a wellbore.

Figure 6:
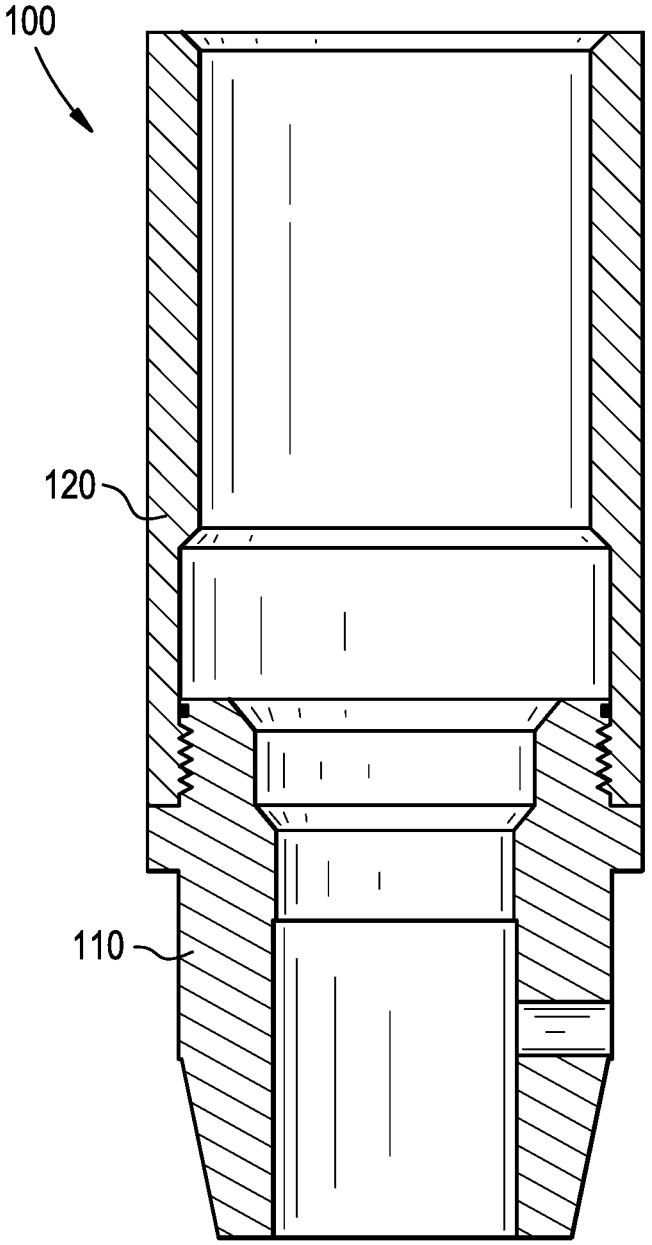
FIG. 6 depicts a downhole tool, according to an embodiment.

FIG. 6 depicts tool 100, according to an embodiment. Elements depicted in FIG. 6 may be described above, and for the sake of brevity a further description of these matters is omitted.

As depicted in FIG. 6, responsive to upper sub-assembly 130 being detached from housing 120 and lower sub-assembly 110, only housing 120 and lower sub-assembly 110 may remain in the wellbore. This may enable upper-sub-assembly 130 to be removed from the wellbore.

Figure 7:
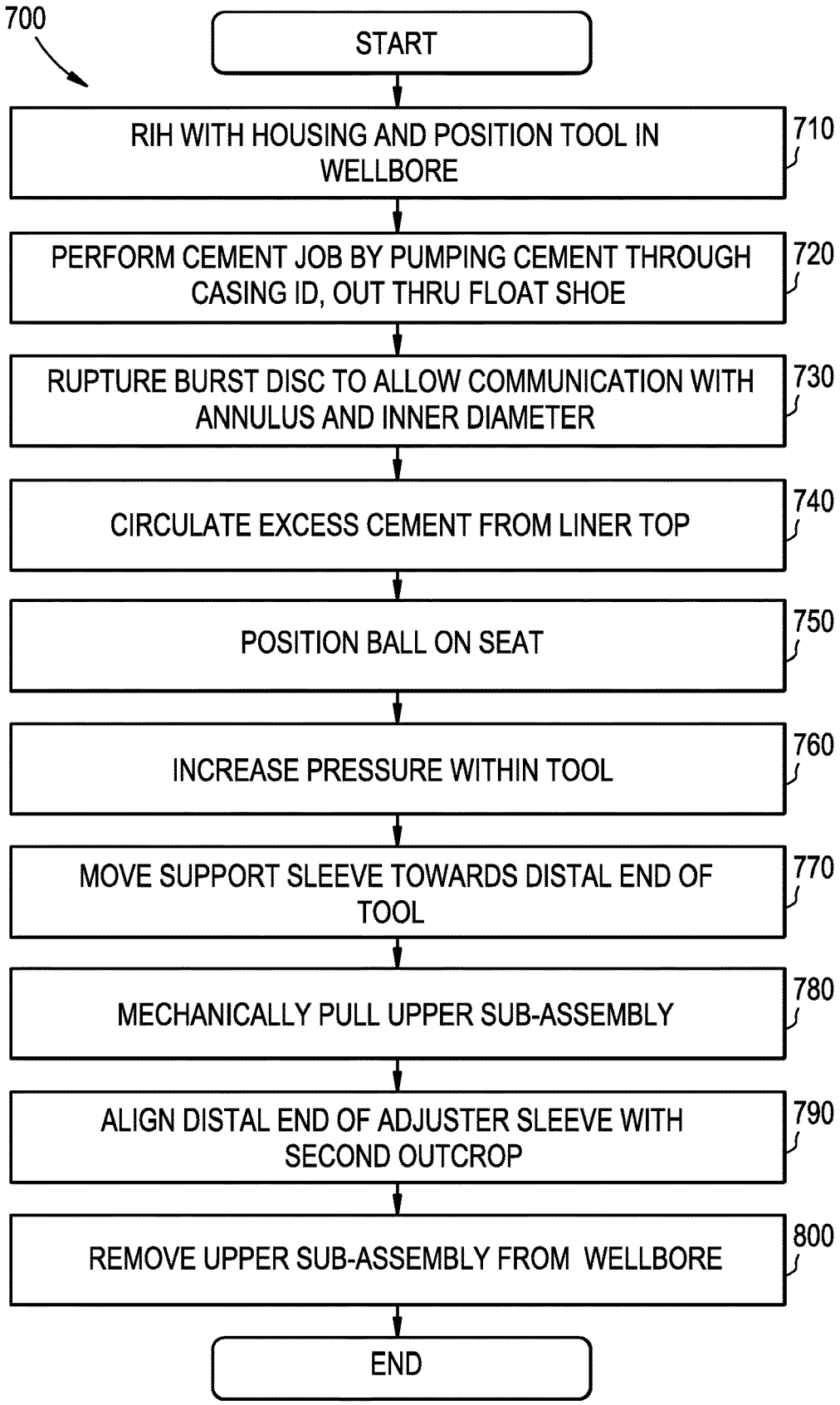
FIG. 7 depicts method utilizing a downhole tool, according to an embodiment.

FIG. 7 depicts a method 700 for detaching an upper sub-assembly from a lower sub-assembly, according to an embodiment. The operations of method 700 presented below are intended to be illustrative. In some embodiments, method 700 may be accomplished with one or more additional operations not described, and/or without one or more of the operations discussed. Additionally, the order in which the operations of method 700 are illustrated in FIG. 7 and described below is not intended to be limiting. Furthermore, the operations of method 700 may be repeated for subsequent valves or zones in a well.

At operation 710, a tool with housing, an upper sub-assembly, and lower sub-assembly may be positioned within a wellbore.

At operation 720, a conventional casing cement job may be performed.

At operation 730, a predetermined amount of pressure may be applied across a burst disc within the lower sub-assembly. The pressure applied to the burst disc may cause the burst disc to rupture, allowing communication between an area within the tool and an area outside of the tool.

At operation 740, circulate through the burst rupture disc to allow any excess cement to be pumped out of the well.

At operation 750, a ball may be positioned on a support sleeve of the upper sub-assembly. The ball may be configured to isolate an area above the ball from an area above the ball.

At operation 760, pressure in the area above the ball within the tool may increase.

At operation 770, responsive to increasing the pressure above the ball within the tool, a shear pin coupling the support sleeve to an adjuster sleeve may shear. The pressure may cause the support sleeve to move towards the distal end of the tool while the adjuster sleeve remains in place. When the support sleeve moves, a distal end of the adjuster sleeve may no longer be aligned with a first outcrop on the support sleeve. This may cause the distal end of the adjuster sleeve to become disengaged with a stop within the casing, and move towards a central axis of the tool.

At operation 790, mechanically pull the upper sub-assembly towards proximal end of tool.

At operation 790, responsive to pulling the upper sub-assembly, the distal end of the adjuster sleeve may be positioned adjacent to a second outcrop and the shaft, wherein the second outcrop may form a ledge over the distal end of the adjuster sleeve.

At operation 800, the upper sub-assembly may be further pulled towards the proximal end of the wellbore. This may allow the upper sub-assembly to be removed from the wellbore, while the lower sub-assembly and housing remain.

Reference throughout this specification to "one embodiment", "an embodiment", "one example" or "an example" means that a particular feature, structure or characteristic described in connection with the embodiment or example is included in at least one embodiment of the present invention. Thus, appearances of the phrases "in one embodiment", "in an embodiment", "one example" or "an example" in various places throughout this specification are not necessarily all referring to the same embodiment or example. Furthermore, the particular features, structures or characteristics may be combined in any suitable combinations and/or sub-combinations in one or more embodiments or examples. In addition, it is appreciated that the figures provided herewith are for explanation purposes to persons ordinarily skilled in the art and that the drawings are not necessarily drawn to scale.

Although the present technology has been described in detail for the purpose of illustration based on what is currently considered to be the most practical and preferred implementations, it is to be understood that such detail is solely for that purpose and that the technology is not limited to the disclosed implementations, but, on the contrary, is intended to cover modifications and equivalent arrangements that are within the spirit and scope of the appended claims. For example, it is to be understood that the present technology contemplates that, to the extent possible, one or more features of any implementation can be combined with one or more features of any other implementation.

What is claimed is:

1. A detachable tool comprising:

an upper sub-assembly formed of an adjuster sleeve and a support sleeve, the adjuster sleeve including an inner projection and an outer projection, the support sleeve having a first outcrop and a second outcrop, the first outcrop being positioned closer to a proximal end of the detachable tool than the second outcrop, and the first outcrop having a larger outer diameter than the second outcrop, wherein the adjuster sleeve includes a shaft and a collet, the outer projection increasing an outer diameter of the collet and the inner projection decreasing an inner diameter of the collet;

a lower sub-assembly, wherein the lower sub-assembly is temporarily coupled with the upper-sub assembly;

the upper sub-assembly being detachable from the lower sub-assembly after moving the support sleeve.

2. The detachable tool of claim 1, wherein the upper sub-assembly includes:

a temporary coupling mechanism configured to selectively couple the adjuster sleeve and the support sleeve at a first location, wherein responsive to the temporary coupling mechanism no longer coupling the adjuster sleeve and the support sleeve the adjuster sleeve and support sleeve are coupled together at a second location utilizing the inner projection on the adjuster sleeve and the first outcrop.

3. The detachable tool of claim 2, further including:

a seat positioned on an inner diameter of the support sleeve, the seat being configured to receive an object to isolate a first area above the seat and a second area below the seat, wherein the temporary coupling mechanism is configured to be decoupled responsive to increasing a pressure in the first area.

4. The detachable tool of claim 3, wherein responsive to increasing the pressure in the first area the support sleeve moves downhole while the adjuster sleeve remains fixed in place.

5. The detachable tool of claim 2, further comprising:

a housing configured to restrict the movement of the adjuster sleeve via a tapered sidewall when the adjuster sleeve is coupled to the support sleeve at the first location.

6. The detachable tool of claim 2, wherein the collet has two internal diameters, first diameter when the adjuster sleeve and the support sleeve are coupled together at the first location and second smaller diameter when the adjuster sleeve and the support sleeve are coupled together at the second location.

7. The detachable tool of claim 2, wherein the support sleeve is configured to move parallel to the axis based on hydraulic pressure while the adjuster sleeve remains fixed in place, and the support sleeve and the adjuster sleeve are configured to simultaneously move up hole based on mechanical force.

8. The detachable tool of claim 7, wherein the support sleeve and the adjuster sleeve are configured to decouple from the bottom sub-assembly based on the mechanical pressure.

9. The detachable tool of claim 2, wherein the support sleeve includes a secondary decoupling mechanism to decouple the support sleeve and a housing, the secondary decoupling mechanism on the support sleeve being configured to allow the support sleeve to detach from the housing at a location that is remote from the temporary coupling mechanism.

10. The detachable tool of claim 2, wherein in a first mode of operation an inner projection is positioned adjacent to an outer diameter of the first outcrop and in a second mode of operation the inner projection is positioned between the first outcrop and second outcrop.

11. The detachable tool of claim 1, wherein the upper sub-assembly and the lower sub-assembly are run in hole together as a single piece, and a passageway extending from an inner diameter of the lower sub-assembly to an outer diameter of the lower sub-assembly is configured to allow for circulation of excess cement after a port is opened.

12. The detachable tool of claim 1, wherein the upper sub-assembly is configured to be removed in a single trip while the bottom sub-assembly remains down hole, wherein the bottom sub-assembly has an inner diameter that is greater than or equal to that of casing.

13. A method associated with a detachable tool comprising:

temporarily coupling an upper sub-assembly with a lower sub-assembly, the upper sub-assembly including an adjuster sleeve and a support sleeve, the adjuster sleeve including an inner projection and an outer projection;

temporarily coupling the adjuster sleeve and the support sleeve together at a first location via a temporary coupling mechanism;

coupling the support sleeve and the adjuster sleeve together at a second location via the inner projection of the adjuster sleeve and a first outcrop on the support sleeve after the temporary coupling mechanism is sheared;

retrieving the support sleeve and the adjuster sleeve together while the support sleeve and adjuster sleeve are coupled together at the second location;

detaching the upper sub-assembly from the lower sub-assembly after moving the support sleeve.

14. The method of claim 13, further comprising:

decoupling the temporary coupling mechanism;

wherein the adjuster sleeve includes a shaft and a collet, and the collet is positioned on a distal end of the shaft, the outer projection increasing an outer diameter of the collet and the inner projection decreasing an inner diameter of the collet, wherein the collet has two internal diameters, first diameter when the adjuster sleeve and the support sleeve are coupled together at a first location and a second smaller diameter when the adjuster sleeve and the support sleeve are coupled together at the second location.

15. The method of claim 14, further including:

positioning an object on a seat positioned on an inner diameter of the support sleeve;

isolating a first area above the seat and a second area below the seat, wherein the temporary coupling mechanism is configured to be decoupled responsive to increasing a pressure in the first area.

16. The method of claim 15, further comprising:

increasing the pressure in the first area the support sleeve moves downhole while the adjuster sleeve remains fixed in place.

17. The method of claim 14, further comprising:

moving the support sleeve in parallel to the axis based on hydraulic pressure while the adjuster sleeve remains fixed in place;

simultaneously moving up hole the support sleeve and the adjuster sleeve a based on mechanical force.

18. The detachable tool of claim 17, further comprising:

decoupling the support sleeve and the adjuster sleeve from the bottom sub-assembly based on the mechanical pressure.

19. The method of claim 13, further comprising:

restricting the movement of the adjuster sleeve via a tapered sidewall within a housing when the adjuster sleeve is coupled to the support sleeve at the first location.

20. A detachable tool configured to be positioned adjacent to existing casing comprising:

an upper sub-assembly with a ball seat, an adjuster sleeve and a support sleeve, the adjuster sleeve including a collet with an inner projection and an outer projection, the support sleeve having a first outcrop and a second outcrop, the first outcrop being positioned closer to a proximal end of the detachable tool than the second outcrop, and the first outcrop having a larger outer diameter than the second outcrop wherein the support sleeve within the detachable tool is configured to move axially;

a lower sub-assembly, wherein the lower sub-assembly is temporarily coupled with the upper-sub assembly;

a passageway extending from an inner diameter of the lower sub-assembly to an outer diameter of the lower sub-assembly, wherein the upper sub-assembly is detachable from the lower sub-assembly after the support sleeve moves axially.

* * * * *